United States Patent [19]

Tillotson

[11] Patent Number: 4,661,380

[45] Date of Patent: Apr. 28, 1987

[54] METHOD FOR COATING A SECONDARY CARPET BACKING

[76] Inventor: John G. Tillotson, 1311 Dana Dr., Dalton, Ga. 30720

[21] Appl. No.: 729,698

[22] Filed: May 2, 1985

[51] Int. Cl.[4] ..... B05D 5/10

[52] U.S. Cl. ..... 427/207.1; 118/261; 118/612; 156/578; 427/428; 428/95

[58] Field of Search ..... 118/203, 204, 261, 612; 156/578; 427/356, 358, 207.1, 428; 428/95

[56] References Cited

U.S. PATENT DOCUMENTS

| | | | |
|---|---|---|---|
| 2,534,321 | 12/1950 | Taylor | 427/356 X |
| 3,864,195 | 2/1975 | Patterson | 428/95 X |
| 3,878,814 | 4/1975 | Braston | 118/261 X |
| 4,375,970 | 3/1983 | Murphy et al. | 118/612 X |

*Primary Examiner*—Robert A. Dawson
*Attorney, Agent, or Firm*—Jones & Askew

[57] ABSTRACT

An improved system and method for applying adhesive to a secondary backing fabric for adhesively laminating the secondary backing to a carpet. A secondary backing fabric is conveyed along a path at a predetermined speed, while an adhesive is deposited onto the surface of a casting roller rotating in a direction opposite to the direction of movement of the secondary backing fabric. A doctoring means spaced a predetermined distance from the surface of the casting roller doctors the adhesive into a layer of predetermined thickness on the casting roller. The secondary backing fabric is then brought into contact with a portion of the adhesive-coated casting roller so that a layer of adhesive is transferred onto the backing fabric. The method for transferring the doctored layer of adhesive from the casting roller to the backing fabric is to pass the backing fabric between the casting roller and a press blade positioned to press the backing fabric against the casting roller and to permit the backing fabric to be withdrawn from the adhesive layer in an arc-shaped path. In this manner, a uniform coating of adhesive is applied to the surfaces of the secondary backing fabric which are to come into contact with the back surface of the carpet while avoiding the wasteful coating of non-contacting surfaces. The secondary backing fabric is then brought into intimate contact with the back surface of the carpet to form a laminated structure. The resulting laminated carpet product exhibits high delamination strength while maintaining economy of construction.

1 Claim, 6 Drawing Figures

METHOD FOR COATING A SECONDARY CARPET BACKING

TECHNICAL FIELD

The present invention relates generally to the construction of laminated carpet fabrics, and more particularly relates to an improved system and method for applying adhesive to a secondary backing fabric for adhesively laminating the secondary backing to a carpet.

BACKGROUND OF THE INVENTION

Laminated carpet fabrics comprising a carpet and a secondary backing fabric affixed to the carpet by an adhesive are known in the art. Numerous adhesives and methods of applying adhesive to fabrics for the purpose of laminating adhesively coated fabrics to other pieces of fabric are also well known.

Typically, an adhesive is applied to a carpet to bond the tufts to the primary backing and to bond the carpet with a secondary backing material to form a laminated structure. After application of the adhesive, the carpet and secondary backing are brought into intimate contact with each other and then are passed between a pair of laminating rollers. The laminating rollers are configured to cause adhesive on the back of the carpet to be transferred from the carpet to the secondary backing and also to maintain the materials in intimate contact. The laminated structure is then typically treated by suitable means to solidify the adhesive.

The quality of the bond between the carpet and secondary backing and the amount of adhesive required are in part determined by the method chosen for applying the adhesive. Various methods are known to the art and fall into two categories. The first category comprises methods which apply the adhesive to the carpet and transfer it from the carpet to the secondary backing. These methods are wasteful of adhesive, since the valleys and depressions in the back surface of the carpet must be substantially full to transfer sufficient adhesive to the secondary backing.

The second category comprises methods for applying adhesive directly to the secondary backing. One method in this category comprises dipping the secondary backing directly into the adhesive, which is again wasteful because it coats surfaces which do not contact the carpet. Another method comprises applying the adhesive to the secondary backing from an adhesive-coated roller. This coated roller method, however, tends to produce a coating on the secondary backing which is so unevenly deposited that an excessive amount of adhesive must be applied to assure adequate lamination strength.

These methods of lamination require the application of relatively large amounts of adhesive to achieve the desired delamination strength of the bond between the carpet and the secondary backing. Such systems are shown in U.S. Pat. Nos. 2,428,358, 3,238,595, 3,567,548, and 3,669,779.

Accordingly, there is a need to provide a method for applying a uniform coating of adhesive to only the surfaces of the secondary backing which are to come in contact with the carpet, while avoiding the coating of non-contacting surfaces and use of excessive adhesive. Further, there is a need to reduce the amount of wasted adhesive while maintaining laminated carpet structures which provide acceptable delamination strength between the carpet and the secondary backing fabric. Prior art processes have not heretofore been able to accomplish these goals with acceptable results.

SUMMARY OF THE INVENTION

The present invention provides an improved method of making a laminated carpet structure and an improved process for applying an adhesive to a secondary backing fabric and for laminating the secondary backing to a carpet. Briefly described, the process comprises conveying an uncoated secondary backing fabric along a predetermined path. An adhesive composition is prepared and deposited on the surface of a casting roller which rotates in a direction opposite to the direction of movement of the secondary backing fabric along the path. The deposited adhesive, which forms a "puddle" on the top of the rotating casting roller, is then passed under doctoring means spaced a predetermined distance above the surface of the casting roller to doctor the adhesive into a thin layer having a predetermined thickness. The secondary backing fabric is then passed between the rotating casting roller and a press blade positioned subsequent to the doctoring means, to press the secondary backing fabric against the counterrotating casting roller to transfer the doctored layer of adhesive onto the secondary backing fabric.

Thereafter, the coated surface of the secondary backing fabric is brought into intimate contact with a precoated back surface of a carpet to form a laminated carpet structure. Preferably, the laminated carpet structure is then compressed to promote the adhesion between the carpet and the secondary backing fabric, preferably by passing the laminated structure through at least one pair of opposed press rollers. Finally, the laminated structure is treated by suitable means to solidify the adhesive, with additional optional compression by opposed press rollers used during the solidification treatment to further promote the bonding of the adhesive.

The result of the preferred method is an improved carpet structure having high delamination strength, with improved cost effectiveness due to the reduced amount of adhesive used to bond the secondary backing to the carpet.

Accordingly, it is an object of the present invention to provide an improved method of laminating carpet and secondary backing fabrics.

It is another object of this invention to provide a method of laminating carpet and secondary backing fabrics which requires less adhesive than conventional methods while maintaining acceptable delamination strength.

It is another object of the present invention to provide an improved method for applying an adhesive composition to a secondary backing fabric in preparation for the bonding of the secondary backing fabric to a carpet.

It is yet another object of this invention to provide a method for applying a uniform coating of adhesive only on the surfaces of a secondary backing fabric which are to come into contact with the back surface of a carpet while avoiding the coating of noncontacting surfaces.

Other objects, features, and advantages of the present invention will become apparent upon reading the following specification when taken in conjunction with the drawing and the appended claims.

DETAILED DESCRIPTION OF THE INVENTION

Figure 1:
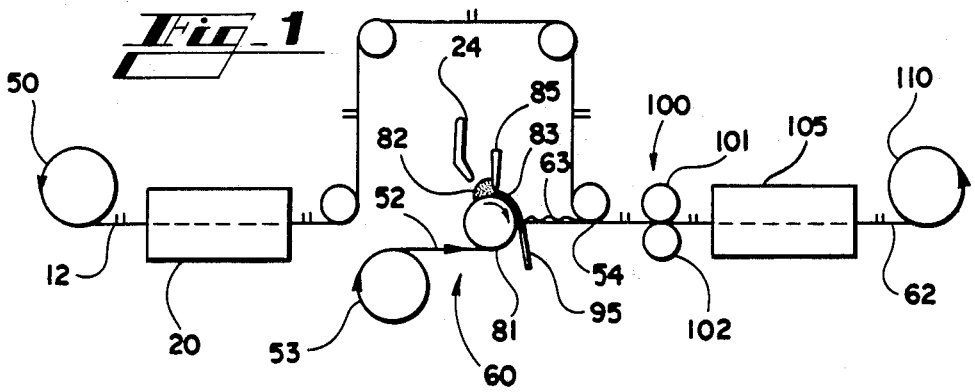
FIG. 1 is a schematic diagram of the preferred method and system for applying an adhesive to a secondary backing fabric, and for joining the coated secondary backing and a precoated carpet, according to an embodiment of the invention.

Referring now in more detail to the drawing, in which like numerals indicate like elements throughout the several views, FIG. 1 schematically represents apparatus for applying a coat of adhesive to a secondary backing fabric and for laminating the coated secondary backing to a precoated carpet according to the method of the present invention. A carpet 12 from a supply roll 50 is adhesively precoated by an anchor coat applicator 20 and conveyed to a combining roll 54. A secondary backing fabric 52 from a supply roll 53 is conveyed along a path through an adhesive coating station 60, which comprises a casting roller 81 rotating in a direction opposite to the direction of movement of the secondary backing. A traversing dispenser 24 is disposed to apply a puddle 82 of adhesive mixture onto the top or upper surface of the casting roller 81. A doctor blade 85 is spaced a predetermined distance from the upper surface of the casting roller 81 to doctor the puddle 82 of adhesive into a layer 83 of predetermined thickness.

In this method, the distance between the doctor blade 85 and the surface of the casting roller 81 is set at about 0.017". In order to ensure an even coating on the secondary backing, variance in the diameter of the casting roller should preferably be maintained within a tolerance of about 5 percent of the gap between the doctor blade and the casting roller. Preferably, then, the diameter of the casting roller should not vary more than about 0.001" for best results.

This method further comprises the step of purging the doctor blade 85 at periodic intervals to allow the escape of accumulations of debris or lumps in the adhesive and to minimize streaking in the applied layer of adhesive. Means are provided for purging by mounting the doctor blade 85 to a pivotable mounting bar which allows the doctor blade to pivot away from the surface of the casting roller 81 to open the gap between the doctor blade and the casting roller. Preferably, the doctor blade is mounted so that the blade can be moved about 0.035" away from the casting roll 81 at periodic intervals of about 5 to about 20 seconds. More or less frequent purging may be required, depending upon the parameters of the adhesive.

After the adhesive composition has been applied in a thin layer 83 to the casting roller 81, the casting roller is contacted with the secondary backing 52 to transfer the coated layer 83 of adhesive onto the secondary backing. The preferred method for transferring the doctored layer of adhesive from the casting roller to the secondary backing is to pass the secondary backing between the counterrotating casting roller 81 and a flexible spring steel press blade 95 positioned to press the secondary backing against the rotating casting roller. This causes the deposited doctored layer 83 of adhesive to be transferred onto the secondary backing while allowing seams or slubs or other unduly thick areas of the secondary backing to pass through the opening between the flexible press blade 95 and the casting roller 81 without excessive interference which might otherwise damage the secondary backing.

Figure 5:
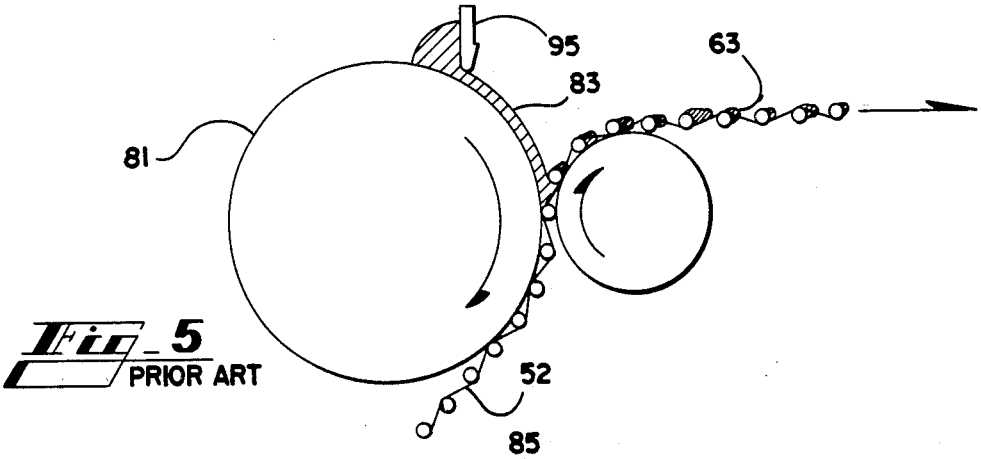
Fig. 5 PRIOR ART

Damaging interference might also be avoided by replacing the press blade with a press roller, as shown in FIG. 5, having a surface speed and direction synchronous with the motion of the secondary backing. However, the use of a flexible press blade not only eliminates the need to move the pressing surface synchronously with the secondary backing fabric but also makes it possible to cause the secondary backing fabric to follow an arc-shaped path of very small radius during the withdrawal of the secondary backing fabric from the adhesive layer.

Subsequent to the deposition of the doctored layer of adhesive onto the secondary backing, the coated surface of the secondary backing 52 is passed under a combining roller 54 to be brought into contact with the back surface of the precoated carpet 12 to form the laminated carpet structure 62.

Subsequent to the combining roller, the preferred method employs a compression station 100 comprising a pair of opposed press rollers 101, 102, which compress the laminated structure 62 to promote the adhesion between the tufted primary backing and the secondary backing.

When the carpet 12 and the secondary backing 52 are compressed by the laminating rollers 101, 102, the adhesive therebetween may have a tendency to be squeezed through the layer of secondary backing onto the lower laminating roller 102, which can result in an undesirable buildup of adhesive on the roller. To avoid this problem, the lower laminating roller 102 is preferably driven at a rate which will provide a roller surface speed different from the linear speed of the laminated carpet structure 62, i.e. a speed either greater than or less than the speed of the laminated carpet structure.

After the compression station 100, the laminated carpet structure 62 may then be treated by suitable means 105 to solidify the adhesive compositions. Additionally, the laminated structure can be compressed by press rollers during the solidification treatment (not illustrated) to further promote adhesion and to further solidify the adhesive compositions. The completed laminated carpet structure 62 may then be wound on a take-up roll 110.

Figure 2:
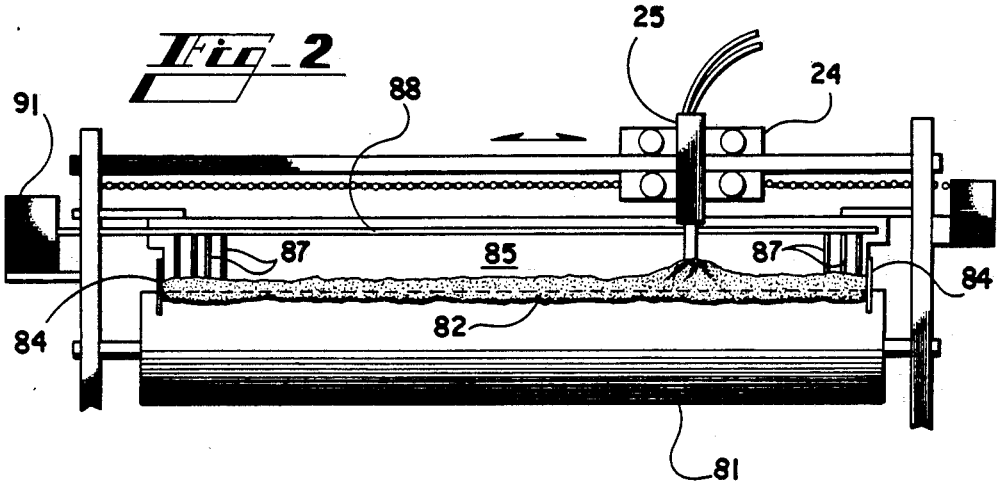
FIG. 2 is a partial detailed front elevational view of a doctor blade, agitation fingers, and ultra-high viscosity traversing dispenser employed in the preferred embodiment.

As shown in FIG. 2, guards or dams 84 mounted near the ends of the casting roller 81 confine the puddle 82 and prevent the adhesive from flowing off the ends of the casting roller. A highly viscous adhesive may adhere to the doctor blade 85 to a degree which may interrupt the flow of adhesive through the opening between the doctor blade and the casting roll 81. To ensure an uninterrupted flow, a plurality of elongate wiper fingers 87 are mounted to extend into the puddle 82 substantially parallel and adjacent to the doctor blade 85. The wiper fingers 87 are mounted on a mounting bar 88 which is oscillated by an oscillating motor 91 to cause the wiper fingers to reciprocate while being held parallel to and closely against the doctor blade 85.

Figure 3:
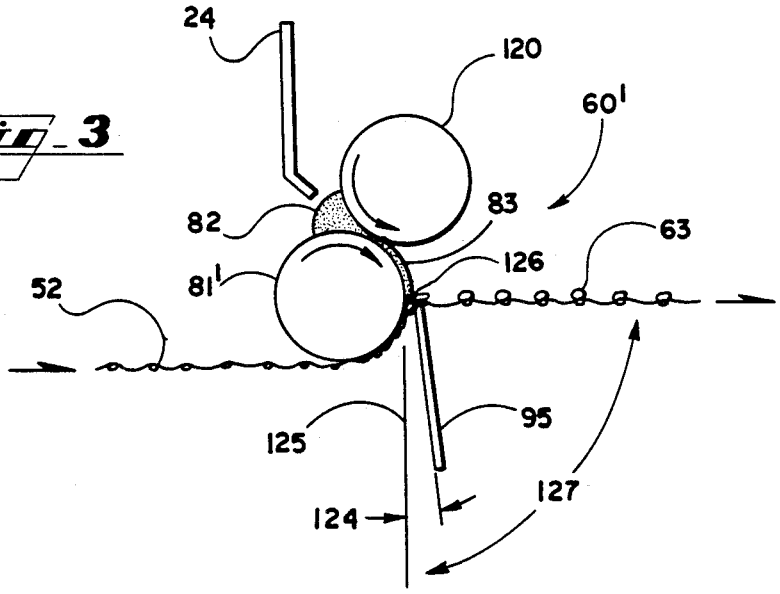
FIG. 3 is a schematic view of an alternate method and system for doctoring a layer of adhesive into a uniform layer of predetermined thickness onto a casting roller for application to a secondary backing fabric.

FIG. 3 illustrates an alternate method of applying a layer of adhesive to the secondary backing. This alternate method comprises conveying the secondary backing 52 through adhesive coating station 60' comprising casting roller 81' and a doctor roller 120 spaced a predetermined distance from the upper surface of the casting roller and rotating in the opposite direction from the casting roller. Traversing dispenser 24 deposits puddle 82 of adhesive onto the upper surface of the casting roller where the doctor roller 120 meters the adhesive into layer 83 of predetermined thickness on the casting roller. Large particles in the adhesive composition are disintegrated as the adhesive passes between the rollers to ensure an uninterrupted flow of adhesive and a smooth continuous layer 83.

In the alternate embodiment of FIG. 3, the doctor roller 120 must rotate slowly enough so that most of the adhesive is deposited on the casting roller 81 in a continuous layer. The desired speed of the doctor roller is less than $\frac{1}{2}$, preferably about 1/10 to about 1/20, the speed of the casting roller. The rotational speed of the casting roller and the distance separating the rollers are controlled so that a predetermined amount of adhesive is placed on the contacting surface of the secondary backing. The preferred speed of the casting roller is from about $\frac{1}{4}$ to about 2 times the speed of the secondary backing, and the preferred opening between the rollers is from about 0.010" to about 0.040".

The opening between the flexible spring steel press blade 95 and the casting roller 81 is controlled so that the secondary backing 52 is pressed closely to the casting roller without risking damage to the secondary backing. The opening may be varied according to the thickness of the secondary backing, and it is preferred to use an opening of from about 0.020" less than to about 0.020" more than the thickness of the secondary backing.

Referring again to FIG. 3 for purposes of illustration, the angle 124 formed between the press blade 95' and a tangent 125 to the casting roller 81' at the adhesive contact point 126 is controlled between about 0° and about 90°, preferably between about 5° and about 25°. The arc described by the path of the secondary backing while it is in contact with the press blade has a radius of between 0.005 inches and 0.5 inches, preferably between 0.01 inches and 0.05 inches.

Figure 4:
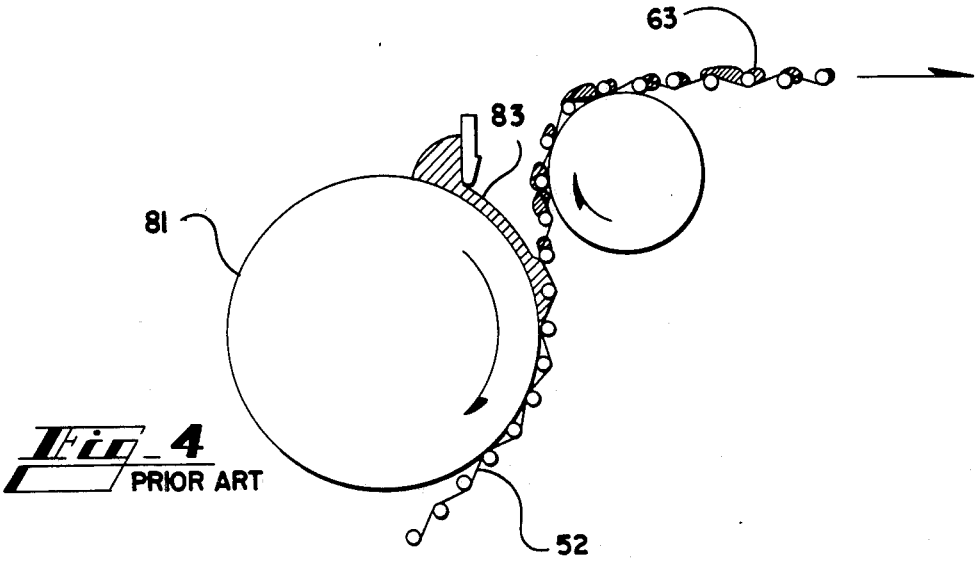
Fig. 4 PRIOR ART
FIGS. 4 and 5 illustrate the application of an adhesive from a casting roller to a secondary backing fabric without the benefit of a press blade.

FIGS. 4 and 5 illustrate the prior art method referred to above for coating a secondary backing fabric, whereby the secondary backing is conveyed along a predetermined path to be brought into contact with a roller 81 which has been coated with an adhesive layer of predetermined thickness. The roller is rotated in a direction opposite to the path of the secondary backing. The secondary backing is wiped against the adhesive film on the roller and then conveyed away from the roller along a path which is either tangential to the casting roller at the point of departure as shown in FIG. 4, or arc-shaped as shown in FIG. 5. The resulting adhesive coating 63 on the secondary backing fabric 52 is so unevenly deposited that adequate lamination strength cannot be achieved unless an excessive amount of adhesive is applied before the secondary backing is laminated to the carpet. These uneven coatings are caused by the gradual withdrawal of the secondary backing away from the adhesive film. The cohesiveness of the preferred adhesives can cause some of the deposited adhesive film 63 to be "pulled" away from the secondary backing and back onto the roller 81 by adhesive film 83. Additionally, the position of the secondary backing fabric relative to the latex film during the gradual withdrawal causes most of the adhesive to be placed on non carpet-contacting surfaces.

Figure 6:
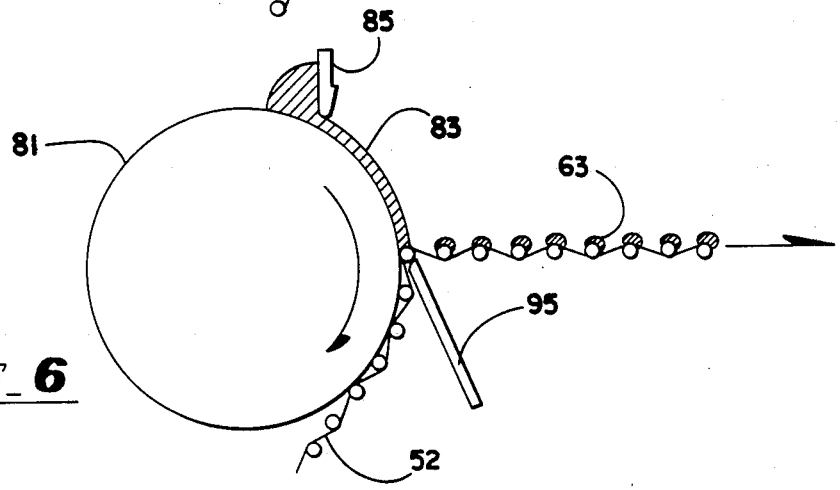
FIG. 6 shows the manner in which a press blade improves the transfer of adhesive from a casting roller to a secondary fabric backing.

In contrast, FIG. 6 shows a method for transferring an adhesive layer 83 onto a secondary backing fabric 52, according to the present invention. The secondary backing fabric 52 is conveyed along a predetermined path and brought into contact with a portion of the adhesive-coated roller 81, which is rotating in a direction opposite to the direction of the secondary backing fabric. A press blade 95 holds the secondary backing fabric against the roller and permits the secondary backing to be drawn away from the roller in an arc-shaped path having a radius of less than 0.5 inches. In this manner, the secondary backing is drawn suddenly away from the casting roller, thereby preventing the cohesiveness of the adhesive layer 83 on the roller from "pulling" the deposited adhesive film 63 away from the secondary backing. In addition, the secondary backing is conveyed away from the roller with the deposited adhesive film 63 on the top surface of the secondary backing as a result of the advantageous positioning of the secondary backing during the withdrawal from the adhesive layer. With this method, it is possible to apply regular and uniform but discontinuous deposits of adhesive to only the high spots on the surface of the secondary backing fabric. Thus, the adhesive is applied most advantageously for contacting the carpet, thereby producing a superior bond while using a minimum amount of adhesive.

It has been found that the preferred adhesive for bonding a secondary backing fabric to a carpet is carboxylated SBR latex. Other acceptable adhesives include natural rubber latex, styrene/butadiene latex, ethylene vinyl acetate latex, acrylic latex, polyurethane elastomers, polyurethane foams, polyvinyl chloride plastisols, and hot melt resins.

Finally, it will be understood that the preferred embodiment of the present invention has been disclosed by way of example, and that other modifications may occur to those skilled in the art without departing from the scope and spirit of the appended claims.

What is claimed is:

1. In a process for laminating a secondary backing fabric to a carpet to form a laminated structure, a method of applying a layer of adhesive to the secondary backing fabric, comprising the steps of:

conveying said secondary backing fabric along a path at a predetermined speed;

depositing a predetermined amount of adhesive onto the top surface of a casting roller rotating in a direction opposite to the direction of movement of said secondary backing fabric, said adhesive being deposited onto said roller adjacent to a doctoring means spaced a predetermined distance from the surface of said casting roller to form a puddle of adhesive adjacent to said doctoring means;

agitating said puddle of adhesive to promote dispersal of said adhesive across the top of said casting roller by disposing a plurality of elongate wiper fingers into said puddle adjacent to said doctoring means and oscillating said elongate wiper fingers transversely to the direction of rotation of said casting roller;

passing said deposited adhesive under said doctoring means to form an adhesive layer of predetermined thickness on said casting roller;

contacting said secondary backing fabric with a portion of said casting roller;

transferring said layer of adhesive from said casting roller to said secondary backing fabric by pressing said secondary backing fabric against said casting roller with a press blade spaced from said casting roller; and conveying said coated secondary backing fabric away from said casting roller.

* * * * *